US008291983B2

(12) United States Patent
Rooks

(10) Patent No.: US 8,291,983 B2
(45) Date of Patent: Oct. 23, 2012

(54) INTAKE FOR SHROUDED ELECTRIC SUBMERSIBLE PUMP ASSEMBLY

(75) Inventor: Mark K. Rooks, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 13/144,382

(22) PCT Filed: Nov. 10, 2009

(86) PCT No.: PCT/US2009/063823

§ 371 (c)(1),
(2), (4) Date: Sep. 30, 2011

(87) PCT Pub. No.: WO2010/056648

PCT Pub. Date: May 20, 2010

(65) Prior Publication Data

US 2012/0012332 A1 Jan. 19, 2012

Related U.S. Application Data

(60) Provisional application No. 61/114,810, filed on Nov. 14, 2008.

(51) Int. Cl.
*E21B 43/00* (2006.01)

(52) U.S. Cl. ..... 166/369; 166/68; 166/69; 166/105; 166/107; 166/372

(58) Field of Classification Search ..... 166/105, 166/68, 370, 372, 369, 69, 107
See application file for complete search history.

(56) References Cited

U.S. PATENT DOCUMENTS

| | | | | |
|---|---|---|---|---|
| 4,749,034 | A * | 6/1988 | Vandevier et al. | 166/105 |
| 4,832,127 | A * | 5/1989 | Thomas et al. | 166/369 |
| 6,595,295 | B1 | 7/2003 | Berry et al. | |
| 6,598,681 | B1 | 7/2003 | Berry | |
| 6,691,782 | B2 | 2/2004 | Vandevier | |

(Continued)

FOREIGN PATENT DOCUMENTS

GB 2438515 B 8/2009

OTHER PUBLICATIONS

"REDA Maximus, High-reliability plug-and-play ESP systems with integrated downhole measurement technology" Schlumberger brochure, www.slb.com/artificiallift, 6 pages, Aug. 2006.

(Continued)

*Primary Examiner* — Giovanna Wright
(74) *Attorney, Agent, or Firm* — Bracewell & Giuliani LLP

(57) ABSTRACT

An electric submersible pump (ESP) assembly comprises an integrated sub-assembly encased within a shroud. The integrated sub-assembly comprises a well fluid intake having a shroud hanger formed in an upper portion thereof, a seal section having a motor head formed in a lower portion thereof, and an electrical conduit extending between the shroud hanger and the motor head. The intake has a plurality of fluid entry slots positioned a select distance from the shroud hanger in order to minimize the space for the accumulation of gas within the shroud. The electrical conduit sealingly extends through the shroud hanger to a receptacle located on an upper portion thereof. Conductors are encased within the conduit and are connected between the receptacle and the motor head. The conduit prevents the conductors from being affected by reservoir fluid and pressures.

20 Claims, 5 Drawing Sheets

U.S. PATENT DOCUMENTS

| | | | | |
|---|---|---|---|---|
| 6,840,324 | B2 | 1/2005 | Pettigrew | |
| 6,932,160 | B2 | 8/2005 | Murray et al. | |
| 7,208,855 | B1 | 4/2007 | Floyd | |
| 7,401,655 | B2 | 7/2008 | Vandevier et al. | |
| 2003/0127223 | A1 | 7/2003 | Branstetter et al. | |
| 2005/0194126 | A1 | 9/2005 | Wang | |
| 2010/0122818 | A1* | 5/2010 | Rooks | 166/369 |

OTHER PUBLICATIONS

"REDA Maximus Motors" Schlumberger brochure, www.slb.com/atrificiallift, 2 pages, Aug. 2006.

"REDA Maximus Protectors" Schlumberger brochure, www.slb.com/artificiallift, 2 pages, Aug. 2006.

"REDA Maximus ProMotor Unit" Schlumberger brochure, www.slb.com/artificiallift, 2 pages, Nov. 2006.

"Poseidon Multiphase Gas-Handling System" Schlumberger brochure, www.slb.com/oilfield, 2 pages, Aug. 2003.

"Poseidon Multiphase Gas-Handling System Case study: Increasing oil production in fields with high gas cut" Schlumberger brochure, www.slb.com/oilfield, 2 pages, Aug. 2003.

"Gas Solutions Technology for Submersible Pump Applications, Efficiently produce high GOR wells with submersible pumps" Schlumberger brochure, www.slb.com/oilfield, 5 pages, Apr. 2004.

Co-pending U.S. Appl. No. 12/619,172 filed Nov. 16, 2009.

* cited by examiner

INTAKE FOR SHROUDED ELECTRIC SUBMERSIBLE PUMP ASSEMBLY

FIELD OF THE INVENTION

This disclosure relates in general to electric submersible pump assemblies and in particular to shrouded electric submersible pump assemblies.

BACKGROUND OF THE INVENTION

In many electric submersible pump (ESP) operations, deep set packers are required to protect casing annulus from contact with reservoir fluid and as a barrier for well control. In these cases, the ESP is located below the packer, which requires a packer penetrator system to be used to connect the ESP's electrical power cable above the packer to the motor lead cable below. In these applications, the penetrator system and the lower motor lead cable can represent a major failure mode for the ESP. Often, a high percentage of failures are directly related to the packer penetrator, motor lead cable, or motor pot head. Additionally, as the packer above the ESP creates a pressure boundary in the annulus, ESP's can not produce with pump intake pressures below the fluid bubble point pressure without creating gas pockets below the packer. This phenomenon often causes operators to reduce production rates from a well as draw downs are restricted to maintain certain pump intake pressures.

An alternative to the conventional packer/ESP installation discussed above is to modify the completion to incorporate the packer below the ESP, thus maintaining the integrity of the casing profile. Because the packer is located below the ESP, the ESP is run inside a concentric encapsulated shroud. The shroud is connected to a shroud hanger, which is connected to production tubing above the pump discharge head of the ESP. The shroud is ultimately connected to a tailpipe/stinger which is inserted into the packer below. This allows reservoir fluid from below the packer to flow through the tailpipe/stinger assembly and into the shrouded ESP. The shroud isolates the casing above the packer from contact with the reservoir fluid, thereby ensuring the integrity of the casing. The ESP power cable is connected to a penetrator system that passes through the shroud hanger and connects to the motor lead cable below. The motor lead cable is connected to the motor at the motor's pot head, thereby providing the electrical power for the ESP. This design requires a penetrator system through the shroud, similar to those required for packers, and it further requires that the penetrator either be spliced to the motor lead cable or be factory molded to the motor lead cable within the shroud. As such, the potential for penetrator failure noted above still exists. Additionally, in this particular design, due to the location of the shroud hanger relative to the pump intake, a pocket of gas may accumulate within the shroud. As a result, pump intake pressures at or below bubble point pressures are not desirable.

A need exists for a technique that reduces ESP assembly failures associated with cable penetrator systems and motor lead cables. Additionally, a need exists for a technique that allows an ESP to produce at or below bubble point pressures when deep set packers are required. The following technique may solve one or more of these problems.

SUMMARY OF THE INVENTION

An electric submersible pump (ESP) assembly has a motor connected to an integrated sub-assembly and encased within a shroud. The integrated sub-assembly has a well fluid intake, a seal section, and an electrical conduit. The seal section includes a motor head incorporated into a lower portion of its body. The motor is connected to the motor head portion of the lower body of the seal section. The well fluid intake has a shroud hanger incorporated into an upper portion of its body. The intake has a plurality of fluid entry slots positioned a select distance from the under side of the shroud hanger in order to minimize the space within the shroud for the accumulation of gas.

The electrical conduit extends between the shroud hanger and the motor head. The conduit sealingly extends through the shroud hanger before connecting to a receptacle located on an upper side of the shroud hanger. Conductors are encased within the conduit and are connected between the receptacle and the motor head. The conduit prevents the conductors, and thus the electrical connection for the motor from being affected by reservoir fluid and pressures.

A tailpipe/stinger is connected to a lower portion of the shroud and is adapted to penetrate a packer when lowered into a well. The tailpipe has a plurality of apertures located in and extending therethrough that allow fluid communication from the outside to the inside of the shroud.

A neck with a connector flange on its upper end extends radially upward from the shroud hanger, above the shrouded sub-assembly. A pump with a connector flange on its lower end is connected to the connector flange on the neck of the shroud hanger, thereby connecting the sub-assembly to the pump.

A power cable is connected to the receptacle on the upper side of the shroud hanger, thereby providing electricity to the motor though the conductors encased within the conduit. The ESP assembly is lowered into a well suspended from production tubing. The tailpipe portion of the shroud penetrates the packer. Pressure communication from below the packer drives reservoir fluid in through the tailpipe before flowing by the integrated sub-assembly components and into the intake. The motor provides the energy to drive the pump which then adds energy to the fluid, thereby increasing production to the surface through production tubing.

DETAILED DESCRIPTION OF THE INVENTION

Figure 1:
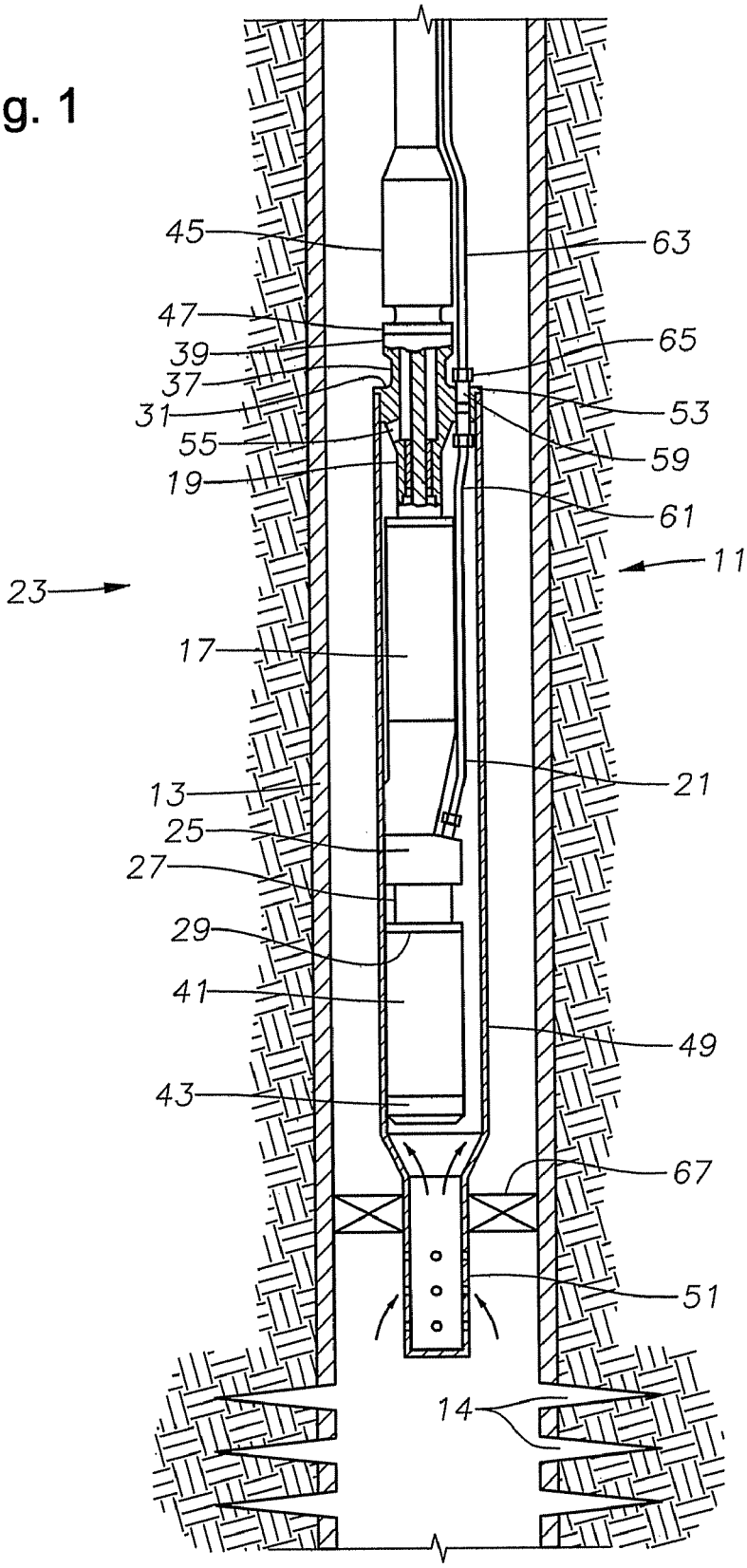
FIG. 1 is a schematic view of a shrouded electric submersible pump (ESP) assembly constructed in accordance with the present invention and supported in a wellbore.
Figure 2A:
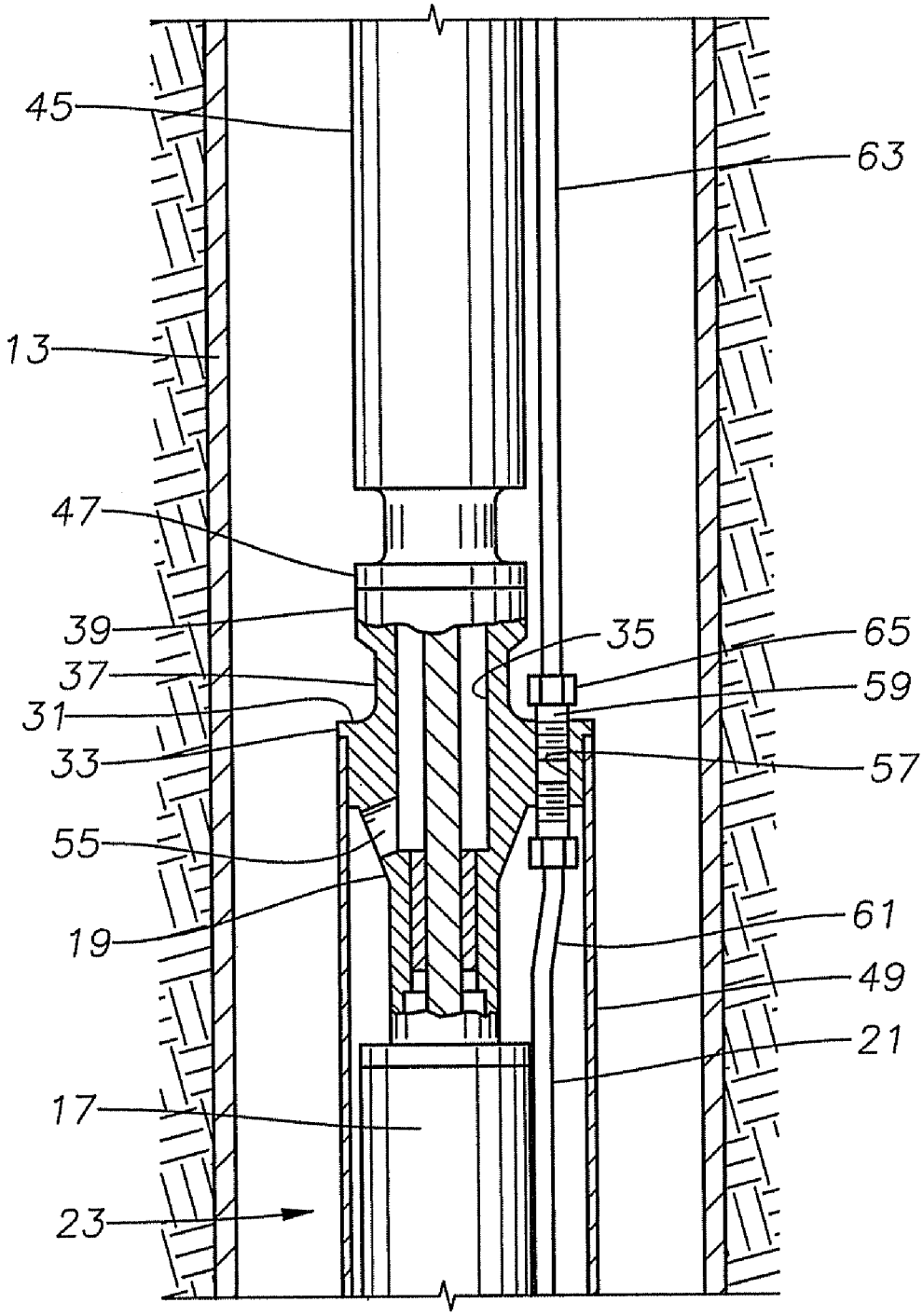
FIG. 2A is an enlarged view of a portion of the ESP assembly of FIG. 1.
Figure 2B:
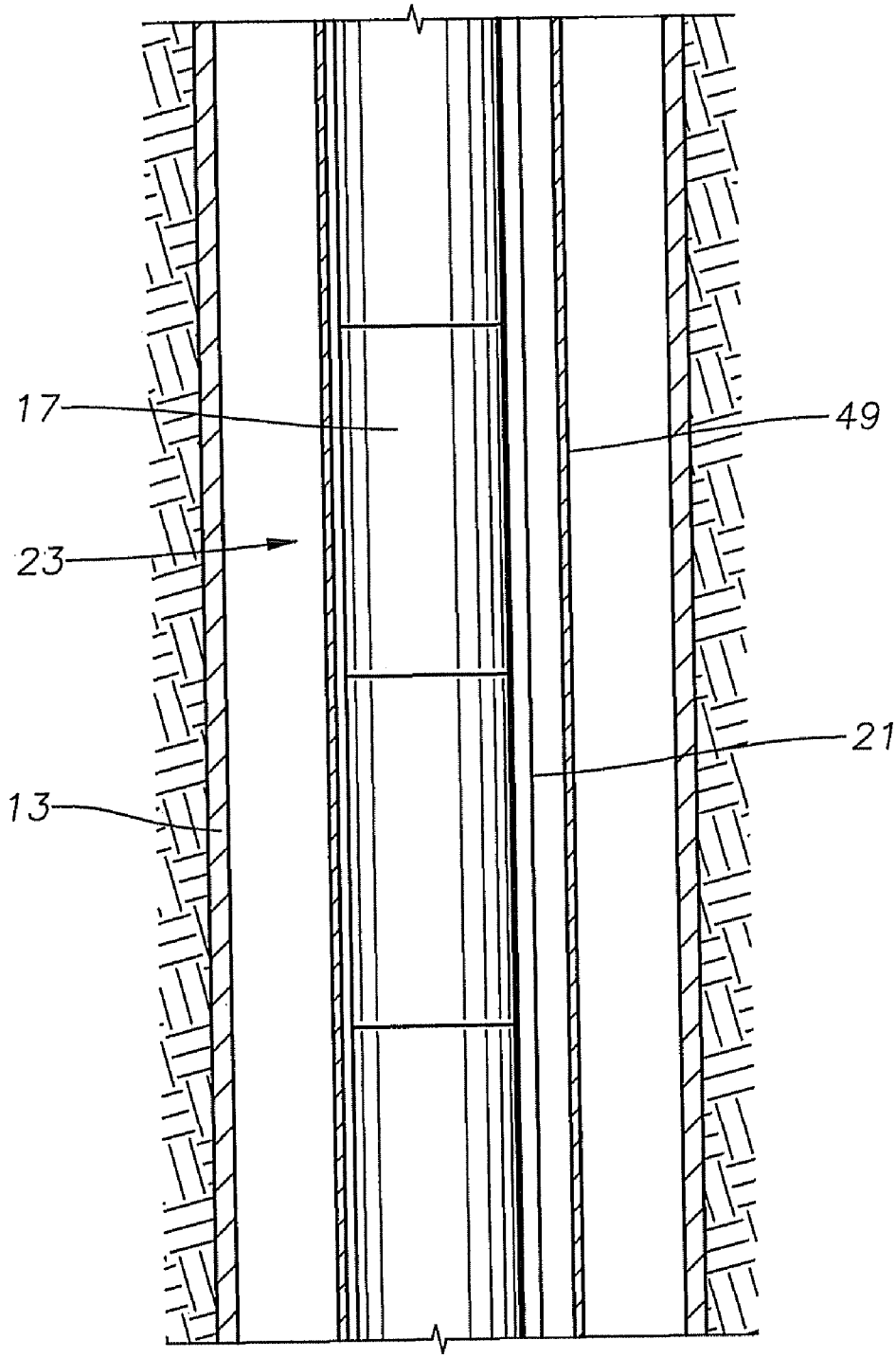
FIG. 2B is an enlarged view of a portion of the ESP assembly of FIG. 1.
Figure 2C:
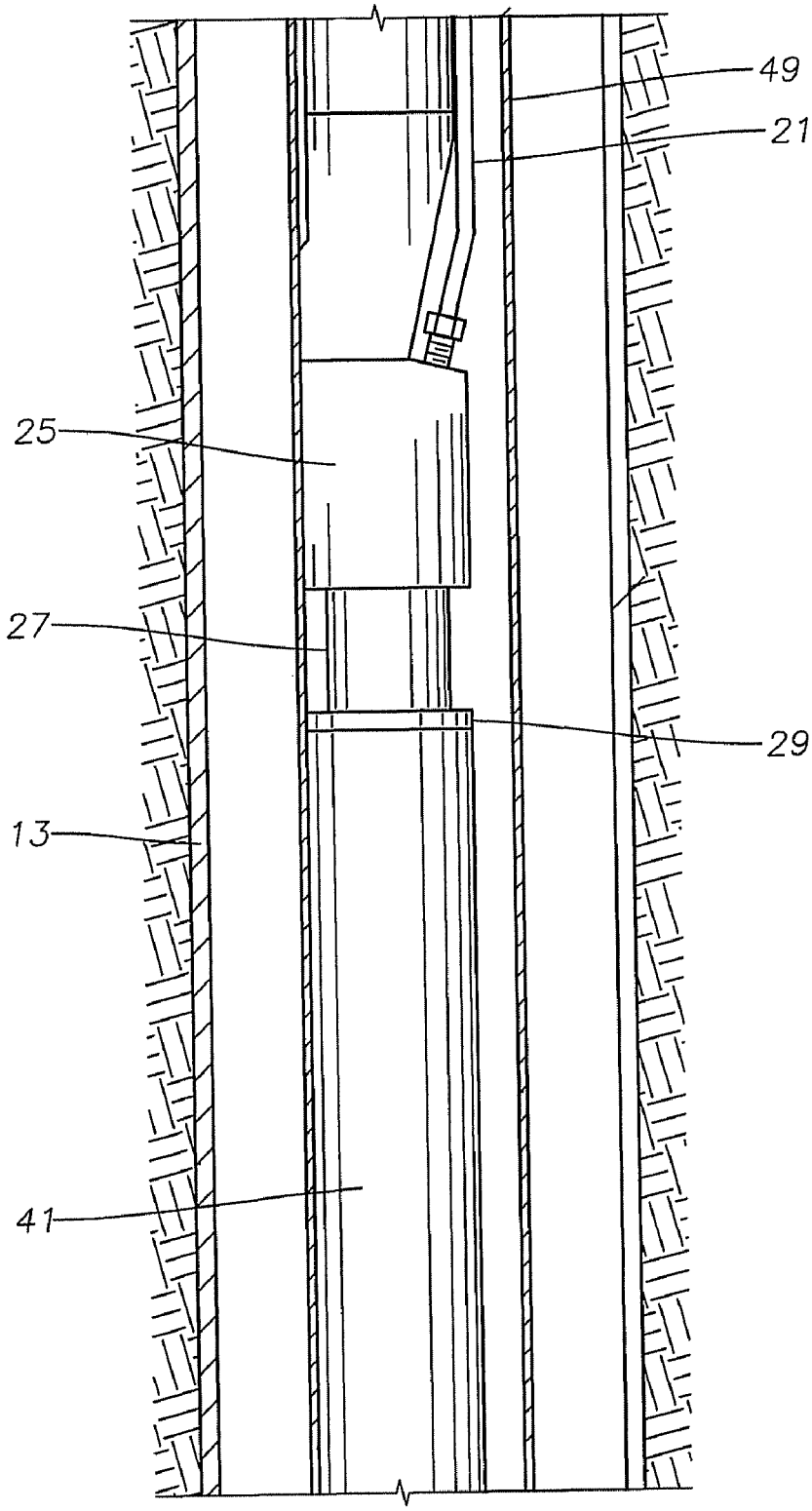
FIG. 2C is an enlarged view of a portion of the ESP assembly of FIG. 1.
Figure 2D:
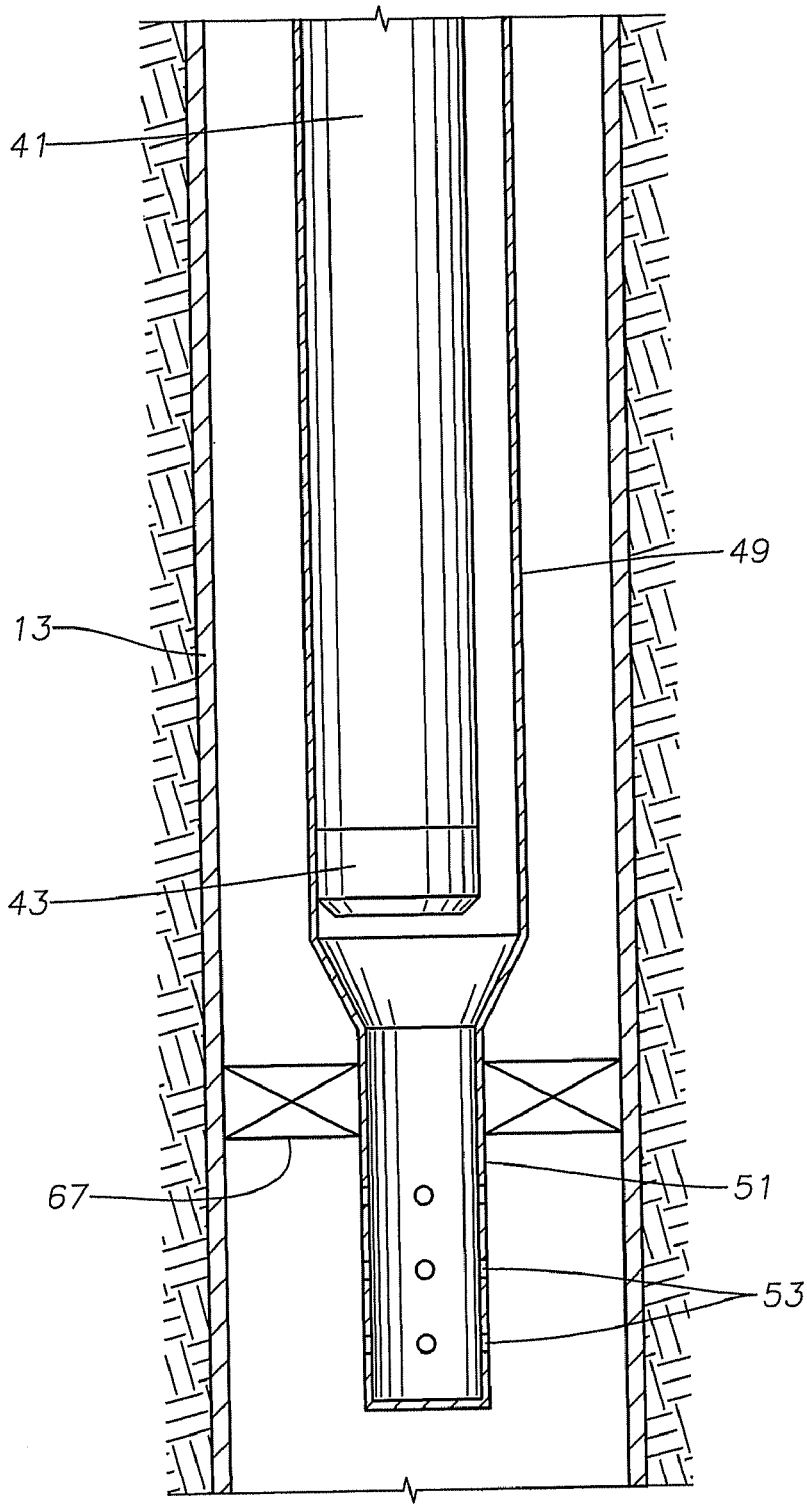
FIG. 2D is an enlarged view of a portion of the ESP assembly of FIG. 1.

FIG. 1 shows a completed well with a downhole, electric submersible pump (ESP) assembly 11 lowered down the casing 13 to above the perforations 14 in the well. The well produces a mixture of oil and water. Referring to FIGS. 2A-D, ESP assembly 11 comprises a seal section 17, a well fluid intake 19, and an electrical conduit 21, all of which are supplied pre-assembled and form an integral sub-assembly 23. A motor head 25 is incorporated into a lower portion of the body of seal section 17. Motor head 25 has a tubular neck 27 joined to and extending downward therefrom. Neck 27 has a connector flange 29 on its lower end. A shroud hanger 31 is incorporated into an upper portion of the body of intake 19. Shroud hanger 31 is a cylindrical tubular member that has an upper flange portion 33 having a greater diameter than a lower portion. Shroud hanger 31 has an axial passage 35 extending therethrough. Shroud hanger 31 has a tubular neck 37 joined to upper flange portion 33 and extending upward. Neck 37 has a connector flange 39 on its upper end.

ESP assembly 11 further comprises a motor 41 and a downhole monitoring gauge or sensor 43 (optional). In one embodiment, sensor 43 may provide motor temperature, ambient temperature, and pressure readings. Motor 41 is a center tandem (CT) type and is typically a three-phase AC motor that is filled with dielectric lubricant. ESP assembly 11 further comprises a pump 45. Pump 45 is a rotary pump driven by a shaft assembly extending from motor 41 through seal section 17. In the preferred embodiment, pump 45 is a centrifugal pump having a number of stages, each stage having an impeller and a diffuser. Pump 45 has a flange 47 on its lower end that bolts to flange 39. Seal section 17 seals well fluid from entry into motor 41 and also has a pressure equalizing device, such as a bladder or labyrinth design for equalizing the lubricant pressure with the hydrostatic pressure of the well fluid. Seal section 17 also allows lubricant to thermally expand and contract, and incorporates a thrust bearing for carrying the axial thrust load from pump 45. The electrical connectors at the bottom of the seal section 17 are developed from the standard tandem motor design so that they can plug directly into motor 41, when it is connected to flange 29. Motor 41 provides the rotational energy to the shaft. The shaft of motor 41 is coupled to an end of the shaft assembly of seal section 17 at flange 29. The shaft assembly extends through seal section 17 and terminates within neck 37. Pump 45 also has a shaft that couples to an end on the shaft assembly at flange 39. As such, the rotational energy is transferred from the motor 41 to the pump 45.

Downhole monitoring gauge 43 (optional), CT motor 41, seal section 17, intake 19, and portions of shroud hanger 31 and electrical conduit 21 are all encapsulated within a shroud 49. Pump 45 is located above shroud hanger 31 and sub-assembly 23, and is connected to shroud hanger 31 via flange 47. A tailpipe/stinger 51 is connected to the lower end of shroud 49. A plurality of perforations or apertures 53 are located in and extend through the tailpipe 51, thereby permitting fluid flow from the outside to the inside of shroud 49.

Integral sub-assembly 23 is placed within shroud 49 and is securely connected to shroud hanger 31. In one embodiment, shroud 49 is bolted to shroud hanger 31. Upper flange portion 33 of shroud hanger 31 has an outer diameter at least equal to that of the inner diameter of the upper end of shroud 49, such that when the lower portion of shroud hanger 31 is inserted into shroud 49, the outer peripheries of upper flange portion 33 abuttingly contact the upper end of shroud 49. In one embodiment, elastomeric seals (not shown) ensure a positive seal between an outer diameter of the lower portion of shroud hanger 31 and an inner diameter of shroud 49.

Intake 19 contains a plurality of fluid entry slots 55 within shroud 49. Entry slots 55 are spaced closely to the lower side of shroud hanger 31, thereby minimizing the space for the entrapment of gas within shroud 49.

As the distance from shroud hanger 31 to motor head 25 of seal section 17 is known, the conventional motor lead cable is replaced with a tubular electrical conduit 21, which may be a rigid tube. Electrical conduit 21 has a lower end connected to the motor head 25. Electrical conduit 21 extends alongside seal section 17 and has an upper end that extends through a sealed passage 57 in shroud hanger 31. The upper end of conduit 21 ends at a reciprocal plug-in terminal block or receptacle 59, located on the upper surface of shroud hanger 31. As a result, the power cable or conductors 61 within electrical conduit 21, extending from motor head 25 to receptacle 59, may be entirely encapsulated in conduit 21, either as three individual conductors or within one large tube with all three conductors. In one embodiment, electrical conduit 21 may comprise three individual stainless tubing electrical conduits. In an additional embodiment, conduit 21 may be connected to motor head 25 below, and shroud hanger 31 above with swagelok technology. Electrical conduit 21 acts as an impermeable power conduit extending from motor head 25 of seal section 17 to shroud hanger 31, thereby providing the electrical continuity for motor 41 during operation.

Receptacle 59 is connected to the power cable or conductors 61 extending through conduit 21. Terminal block 59 is capable of accepting a pothead style cable attachment. In order to supply electrical power to motor 41, a main power cable 63 extending from the surface has an end connector 65 that is connected or plugged-in to terminal block 59 on the top surface of shroud hanger 31.

In operation, sub-assembly 23, comprising intake 19, seal section 17, and electrical conduit 21, is brought to the well site as a single integrated assembly. Pump 45, motor 41, sensor 43 (optional), and shroud 49 are brought to the well site as separate and independent components of the ESP assembly 11. ESP assembly 11 will incorporate a packer 67 within casing 13. Packer 67 includes a mechanical fluid isolation valve (not shown) for maintaining the integrity of the casing profile above packer 67 and acting as a barrier for well control. Motor 41 is connected to flange 29 on motor head 25 of seal section 17. Sensor 43 (optional) is connected to motor 41. Integrated sub-assembly 23, including motor 41 and sensor 43, is then placed inside the concentric encapsulated shroud 49 at the well site. As a result, the lower portion of shroud hanger 31 is inserted into shroud 49. Shroud hanger 31 is securely connected to shroud 49 ensuring that upper flange portion 33 of shroud hanger 31 abbutingly contacts the upper end of shroud 49, securely connecting sub-assembly 23 to shroud 49. As previously discussed, in one embodiment, elastomeric seals (not shown) seal the surface between shroud 49 and the lower portion of shroud hanger 31.

Pump 45 is securely connected to sub-assembly 23 by way of bolting connector flange 47 to connector flange 39. Once pump 45 is securely connected to shroud hanger 31, power cable 63 and plug 65 are connected to receptacle 59 on the upper surface of shroud hanger 31. Once ESP assembly 11 is fully assembled, it is lowered into casing 13.

Tail pipe 51 extending from the bottom of shroud 49 is inserted into and penetrates packer 67, which has been previously installed within casing 13. Once tail pipe 51 has penetrated packer 67, thereby opening the mechanical fluid isolation valve (not shown), ESP assembly 11 may be operated.

Motor 41 receives power from electric cable 63 through the conductors 61 contained with power conduit 21 and thereby drives pump 45. Pump 45 produces fluid from the well through apertures 53 in tail pipe 51 as indicated by arrows. The fluid flows past motor 41, acting as a coolant, and continue upwards into fluid entry slots 55 on intake 19 as indicated by arrows. Fluid continues upwards through pump 45 and up to the surface through production tubing. As the fluid flows through shroud 49, conductors 61, encased within conduit 21, are unaffected by reservoir fluid or pressures.

The technique has significant advantages. The installation time of an ESP will be greatly reduced by incorporating the integrated sub-assembly 23. Additionally, the location of shroud hanger 31 relative to fluid entry slots 55 ensures any free gas developing within shroud 49 will be ingested into pump 45 before accumulating, thereby allowing the ESP to operate below the bubble point pressure. Furthermore, the technique eliminates the conventional motor lead cable and packer penetrator systems, thereby eliminating the risk of failure associated with those systems due to exposure to reservoir fluid and pressures.

While the technique has been shown in only one of its forms, it should be apparent to those skilled in the art that it is not so limited but is susceptible to various changes without departing from the scope of the technique.

The invention claimed is:

1. An apparatus for pumping fluids, comprising:

a shroud having an enclosed interior with a well fluid inlet on a lower end;

a tubular well fluid intake having an aperture in fluid communication with the interior of the shroud, the well fluid intake having a shroud hanger formed in an upper portion thereof, the shroud hanger sealingly mounted within an upper end of the shroud, the shroud hanger having an axial passage therethrough and a tubular neck protruding above the shroud, the neck having a connector flange on an upper end;

a motor located below and connected to the tubular well fluid intake by a seal section, the motor and the seal section being located within the shroud, the seal section having a motor head formed in a bottom portion thereof;

an electrical conductor connected to and extending from the motor head alongside the seal section and sealingly through the shroud hanger;

an electrical receptacle joining the conductor and mounted to an upper side of the shroud hanger;

a pump having a connector flange on a lower end that is bolted to the connector flange on the neck; and a power cable extending alongside the pump, the power cable having an end connector that couples to the receptacle.

2. The apparatus of claim 1, further comprising a conduit extending from the motor head to the receptacle, the electrical conductor being encased within the conduit.

3. The apparatus of claim 1, wherein the shroud hanger further comprises:

an upper flange portion having an outer diameter equal to or greater than the inner diameter of the upper end of the shroud, and a lower portion having an outer diameter less than the upper flange portion; and wherein portions of a lower side of the upper flange portion are in abutting contact with the upper end of the shroud, and the outer diameter of the lower portion is sealingly engaged with the inner diameter of the upper end of the shroud.

4. The apparatus of claim 3, further comprising:

set bolts extending through the shroud and into the lower portion of the shroud hanger to thereby securely connect the shroud to the shroud hanger.

5. The apparatus of claim 4, further comprising:

elastomeric seals positioned between the outer diameter of the lower portion of the shroud hanger and the inner diameter of the shroud to thereby sealingly engage the shroud and the shroud hanger.

6. The apparatus of claim 1, further comprising a downhole monitoring gauge connected to the motor within the shroud.

7. The apparatus of claim 1, wherein the shroud further comprises a tapered lower portion thereof adapted to penetrate a packer within a well.

8. An apparatus for pumping fluids, comprising:

a shroud having an enclosed interior with a well fluid inlet on a lower end;

a tubular well fluid intake having an aperture in fluid communication with the interior of the shroud, the well fluid intake having a shroud hanger formed in an upper portion thereof, the shroud hanger sealingly mounted within an upper end of the shroud, the shroud hanger having an axial passage therethrough and a tubular neck protruding above the shroud, the neck having a connector flange on an upper end;

a motor located below and connected to the tubular well fluid intake by a seal section, the motor and the seal section being located within the shroud, the seal section having a motor head formed in a bottom portion thereof;

an electrical conductor connected to and extending from the motor head alongside the seal section and sealingly through the shroud hanger;

an electrical receptacle joining the conductor and mounted to an upper side of the shroud hanger;

a conduit extending from the motor head to the receptacle, the electrical conductor being encased within the conduit; and a pump having a connector flange on a lower end that is bolted to the connector flange on the neck.

9. The apparatus of claim 8, wherein the shroud hanger further comprises:

an upper flange portion having an outer diameter equal to or greater than the inner diameter of the upper end of the shroud, and a lower portion having an outer diameter less than the upper flange portion; and wherein portions of a lower side of the upper flange portion are in abutting contact with the upper end of the shroud, and the outer diameter of the lower portion is sealingly engaged with the inner diameter of the upper end of the shroud.

10. The apparatus of claim 9, further comprising:

set bolts extending through the shroud and into the lower portion of the shroud hanger to thereby securely connect the shroud to the shroud hanger; and elastomeric seals positioned between the outer diameter of the lower portion of the shroud hanger and the inner diameter of the shroud to thereby sealingly engage the shroud and the shroud hanger.

11. The apparatus of claim 8, further comprising a power cable extending alongside the pump, the power cable having an end connector that couples to the receptacle.

12. The apparatus of claim 11, further comprising a downhole monitoring gauge connected to the motor within the shroud.

13. The apparatus of claim 12, wherein the shroud further comprises a tapered lower portion thereof adapted to penetrate a packer within a well.

14. A method for pumping well fluid, comprising:

(a) providing a shroud having an enclosed interior with a well fluid inlet on a lower end, a tubular well fluid intake having an aperture in fluid communication with the interior of the shroud, the well fluid intake having a shroud hanger formed in an upper portion thereof, the shroud hanger having an axial passage therethrough and a tubular neck protruding above the shroud, the neck having a connector flange on an upper end, a seal section connected to the tubular well fluid intake, the seal section having a motor head formed in a bottom portion thereof, an electrical conductor connected to and extending from the motor head alongside the seal section and sealingly through the shroud hanger, an electrical receptacle joining the conductor and mounted to an upper side of the shroud hanger, a motor, a pump having a connector flange on a lower end, and a power cable having an end connector;

(b) securely connecting the motor to the motor head of the seal section;

(c) sealingly mounting the shroud hanger into an upper end of the shroud, thereby encasing the well fluid intake, the seal section, the motor, and the conductor within the shroud;

(d) bolting the connector flange of the pump to the connector flange on the neck of the shroud hanger;

(e) extending a power cable alongside the pump, and connecting the power cable to the electrical receptacle to thereby provide electricity to the motor;

(f) lowering the assembly into a well;

(g) operating the motor in the well;

(h) flowing the well fluid past and in contact with the motor; and (i) directing the fluid into the intake and the pump, which pumps the well fluid to the surface.

15. The method of claim 14 wherein step (c) further comprises extending a plurality of bolts through an upper portion of the shroud and into the shroud hanger to thereby securely connect the shroud hanger to the shroud.

16. The method of claim 14 wherein step (a) further comprises:

providing elastomeric seals on an outer diameter of a lower portion of the shroud hanger; and wherein step (c) further comprises sealingly engaging the elastomeric seals with the inner surface of the shroud to thereby seal the surfaces between the shroud hanger and the shroud.

17. The method of claim 14 wherein steps (b), (c), (d), and (e) are performed at the well site.

18. The method of claim 14 wherein steps (b) and (c) are performed off site.

19. The method of claim 14 wherein step (b) is performed off site.

20. The method of claim 14, wherein the shroud hanger further comprises:

an upper flange portion having an outer diameter equal to or greater than the inner diameter of the upper end of the shroud, and a lower portion having an outer diameter less than the upper flange portion; and wherein step (c) further comprises:

abbutingly contacting portions of a lower side of the upper flange portion with the upper end of the shroud, and sealingly engaging the outer diameter of the lower portion with the inner diameter of the upper end of the shroud.

* * * * *